US009810385B1

(12) United States Patent
Bonds

(10) Patent No.: US 9,810,385 B1
(45) Date of Patent: Nov. 7, 2017

(54) WORK LIGHT

(71) Applicant: Alexander Bonds, Post Falls, ID (US)

(72) Inventor: Alexander Bonds, Post Falls, ID (US)

(73) Assignee: Alexander Bonds, Post Falls, ID (US)

( * ) Notice: Subject to any disclaimer, the term of this patent is extended or adjusted under 35 U.S.C. 154(b) by 0 days.

(21) Appl. No.: 15/351,707

(22) Filed: Nov. 15, 2016

(51) Int. Cl.

| | |
|---|---|
| ***F21L 4/00*** | (2006.01) |
| ***F21V 23/04*** | (2006.01) |
| ***F21V 21/088*** | (2006.01) |
| *F21Y 115/10* | (2016.01) |

(52) U.S. Cl.
CPC ..... *F21L 4/005* (2013.01); *F21V 21/0885* (2013.01); *F21V 23/0428* (2013.01); *F21Y 2115/10* (2016.08)

(58) Field of Classification Search
USPC ..... 362/191, 208, 217.01, 217.1
See application file for complete search history.

(56) References Cited

U.S. PATENT DOCUMENTS

| | | | | |
|---|---|---|---|---|
| 4,516,194 | A | 5/1985 | Johns | |
| 5,845,985 | A | 12/1998 | Xiong et al. | |
| 6,719,473 | B1 | 4/2004 | Kao | |
| 7,579,567 | B2 | 8/2009 | Lee et al. | |
| 8,562,184 | B2 | 10/2013 | Klipstein et al. | |
| 8,939,602 | B2 | 1/2015 | Wessel | |
| 9,649,873 | B2 * | 5/2017 | Alzhrany | B43K 29/10 |
| 2006/0176681 | A1 | 8/2006 | Krimmer | |
| 2014/0085876 | A1 | 3/2014 | Fields et al. | |
| 2014/0307426 | A1 | 10/2014 | Whitfield et al. | |

* cited by examiner

*Primary Examiner* — Vip Patel
(74) *Attorney, Agent, or Firm* — Randall Danskin P.S.

(57) ABSTRACT

A pocket carried work light has an elongate body with a first end, a second end, and defines a medial channel extending between the ends, the medial channel carrying a battery. A first electrode in the medial channel that electrically communicates with the battery and an electric circuit, a second electrode in the medial channel that communicates the battery and with the electric circuit and a switch communicating with the electric circuit. A pocket clip carried by the body and extending spacedly adjacent and parallel thereto, the pocket clip carrying a low intensity LED on a second surface opposite the body, the LED electrically communicating with the circuit to emit light waves when the electrical circuit is completed by operation of the switch.

14 Claims, 3 Drawing Sheets

WORK LIGHT

TECHNICAL FIELD

This application relates to work lights.

BACKGROUND OF THE INVENTION

Work lights which need to be held in an operator's hands are well known, and are commonly called flashlights. Unfortunately, the basic requirement that such lights be held by the operator, and thus occupying use of one of the user's hands is a significant detriment, especially when the user needs to keep both hands free.

Lamps which do not have to be held in a user's hands, but are carried upon a user's body by means of belts, or other apparatus are also known, and are frequently in the form of headlamps which may be releasably secured to a user's head by means of elastic straps, or alternatively fixedly attached to a hat, or helmet worn by a user, such as in the case of underground miners.

Headlamps present a problem in that they are difficult to attach in a non-slip manner if they are worn over a hat or cap, or the like. Because of their mass headlamps may also slip or move in the case of sudden movements of the head. Moreover, the tension of the forehead strap and the weight of the headlamp may cause the wearer to develop a headache, or neck ache. Further, the donning of such a headlamp requires specific concerted action by the user. Since headlamps are worn on a wearer's head, the light beam of the lamp always follows the movement of the wearer's head. However, it is this very feature of headlamps that is disadvantageous during various activities.

Headlamps are also disadvantageous when two or more persons are talking to each other because the headlamps may blind the other person if the two people are facing one another. Similarly, most headlamps are "spotlight" type apparatus that focus the illumination into a narrow beam that is concentrated on a single spot, rather than widely dispersing the light across a wider area with lower intensity.

The present invention provides a low intensity work light wherein illumination is distributed over a wide area, with low intensity, and at a level vertically below a user's eyes such that the illumination does not blind others, is not a spotlight, and still provides sufficient illumination to locate items, and improve night vision.

One characteristic of known lamps that is particularly disadvantageous in law enforcement, is that wearing a body mounted high intensity light, allows perpetrators of crimes, criminals, and the like who might seek to avoid capture and to harm law enforcement officers to clearly identify the law enforcement officer from a distance in the dark. High intensity body worn lights therefore provide a "target" to which a criminal or other perpetrator of crime might use to target a law enforcement officer with a firearm, or the like. Therefore, there is a significant safety risk in law enforcement officers wearing high intensity body mounted light sources.

The instant invention overcomes various of these drawbacks while providing an apparatus that assists with night vision and performance of duties and work.

SUMMARY OF THE INVENTION

A work light comprising a body having a first end, a second end, an outer circumferential surface and defining a medial channel extending between the first end and the second end. A base obstructing the medial channel and carrying a first electrode that electrically communicates with an electric circuit. A cap obstructing the medial channel and spaced apart from the base, the cap carrying a second electrode that communicates with the electric circuit. A power supply within the medial channel and communicating with both the first electrode and the second electrode. A switch communicating with the electric circuit to alternatively open the electric circuit and to complete the electric circuit. A clip carried by the body and extending spacedly adjacent and parallel to the body, the clip having a first surface proximate the body and a second surface opposite the body. A light emitting diode carried on the second surface of the clip opposite the body and electrically communicating with the circuit and so as to emit light waves when the electrical circuit is completed by operation of the switch.

A further aspect of the instant work light is a threaded orifice defined in the first end of the body and spaced apart from the base to releasably threadably carry a tool.

A further aspect of the instant work light is a first electrical trace communicating between the first electrode and a first electrical contact of the switch and a second electrical trace communicating between the second electrode and the light emitting diode, and a third electrical trace communicating between the light emitting diode and a second electrical contact of the switch.

A further aspect of the instant work light is a light emitting diode socket defined in the second surface of the clip proximate an end of the clip opposite the switch.

A further aspect of the instant work light is wherein the body is generally cylindrical and tubular.

A further aspect of the instant work light is wherein the power supply is a battery.

A further aspect of the instant work light is wherein the light emitting diode emits between approximately one lumen of light and approximately five lumens of light when the electric circuit is completed.

A further aspect of the instant work light is wherein the switch is a push-button switch.

A further aspect of the instant work light is wherein the switch is twist activated.

A further aspect of the instant work light is wherein the clip has an end portion opposite the light emitting diode that structurally communicates with the body.

A further aspect of the instant work light is wherein the clip has an end portion opposite the light emitting diode that structurally communicates with the cap.

A still further aspect of the present invention is a work light comprising a generally cylindrical tubular body having a first end, a second end, an outer circumferential surface and defining a medial channel extending between the first end and the second end; a base carried by the body that obstructs the medial channel, and the base carries a first electrode that electrically communicates with an electric circuit; a cap carried at the second end of the body and obstructing the medial channel, the cap carrying a second electrode within the medial channel that communicates with the electric circuit and the cap further carrying a switch that communicates with the electric circuit; a power supply carried within the medial channel and electrically communicating with both the first electrode and the second electrode; a pocket clip having a first end portion carrying a diametrically enlarged mass, a second end portion proximate the body cap and communicating with the body, the pocket clip having a first surface spacedly adjacent the outer circumferential surface of the body and a second surface opposite the body, and the pocket clip extends generally parallel to the body from the second end of the body toward the first end of the body; a light emitting diode carried on the second surface of the pocket clip proximate the first end portion of the pocket clip, the light emitting diode electrically communicating with the circuit and the switch; and the light emitting diode emits light waves outwardly therefrom when the electrical circuit is completed by operation of the switch.

DETAILED DESCRIPTION OF THE PREFERRED EMBODIMENTS

Figure 1:
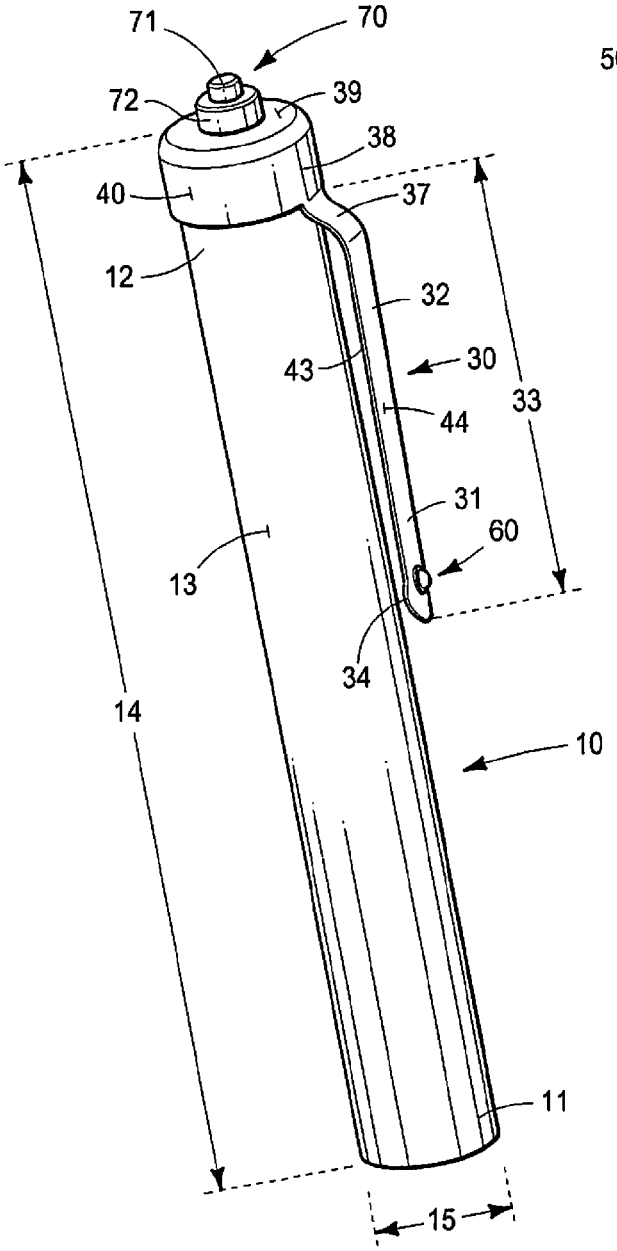
FIG. 1 is an isometric top and side view of the instant work light invention.

This disclosure of the invention is submitted in furtherance of the constitutional purposes of the U.S. Patent Laws "to promote the progress of science and useful arts" (Article 1, Section 8).

The instant invention is a work light having a body 10, a clip 30, a power supply 50, a light emitting diode (LED) 60, a switch 70 and a circuit 80.

The body 10 is generally elongate having a first end 11, a second end 12 with a length 14 between the first end 11 and the second end 12 and having an outer circumferential surface 13 extending thereabout. The body 10 further has a diameter 15 and defines a medial channel 16 extending from the first end 11 to the second end 12. At least a portion of the medial channel 16 is used as a power supply compartment in which the power supply 50 is positionally retained. In the preferred embodiment, the power supply 50 is a battery, and may further be plural batteries.

A base 18 is carried within the medial channel 16 and may be at the first end 11 of the body 10 (FIG. 3) or may be spaced apart from the first end 11 (FIG. 6) toward the second end 12 depending upon the particular embodiment. A first electrode 19 is carried by the base 18 within the medial channel 16 and opposite the first end 11. The first electrode 19 is in electrical connectivity with the power supply 50 and also with electrical trace 81.

Figure 2:
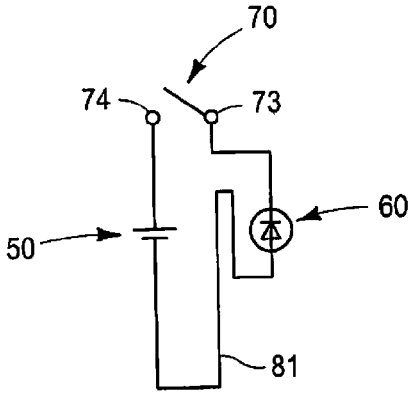
FIG. 2 is a circuit diagram of the instant invention.

The switch 70 is carried at the second end 12 of the body 10. The switch 70 preferably has a push button 71 and a base portion 72 extending about the push button 71 so that the push button 71 is axially moveable relative to the base portion 72. The switch 70, as shown in FIG. 2, has a first electrical contact 73 and a second electrical contact 74 and carries a second electrode 20. The switch 70 and the first electrical contact 73 and the second electrical contact 74 electrically communicate with the power supply 50 and also with the light emitting diode 60. Electrical traces 81 extend between the first and second electrical contacts 73, 74, the first and second electrodes 19, 20 and the light emitting diode 60 to form the electrical circuit 80.

The first and second electrodes 19, 20 are in electrical communication with the switch 70 and with the electrical traces 81 so that both an anode 51 and a cathode 52 of the power supply 50 carried within the medial channel 16 is in electrical connectivity with the circuit 80. As noted previously, in the preferred embodiment the power supply 50 is a battery, such as, but not limited to an AA battery or an AAA battery. Both of which have diameters (not shown) that allow the batteries to be axially carried within the medial channel 16.

As shown in the Figures, the clip 30 which is more descriptively a pocket clip, has a first end portion 31, a second end portion 32 and a length 33 between the first end portion 31 and the second end portion 32. The clip 30 extends generally parallel to and along the outer circumferential surface 13 of the body 10 from a position proximate to the second end 12 towards the first end 11. The clip 30 further has a first surface 43 that is proximate the body 13 outer circumferential surface 13 and an opposing second surface 44 that is opposite the body 10.

Figure 6:
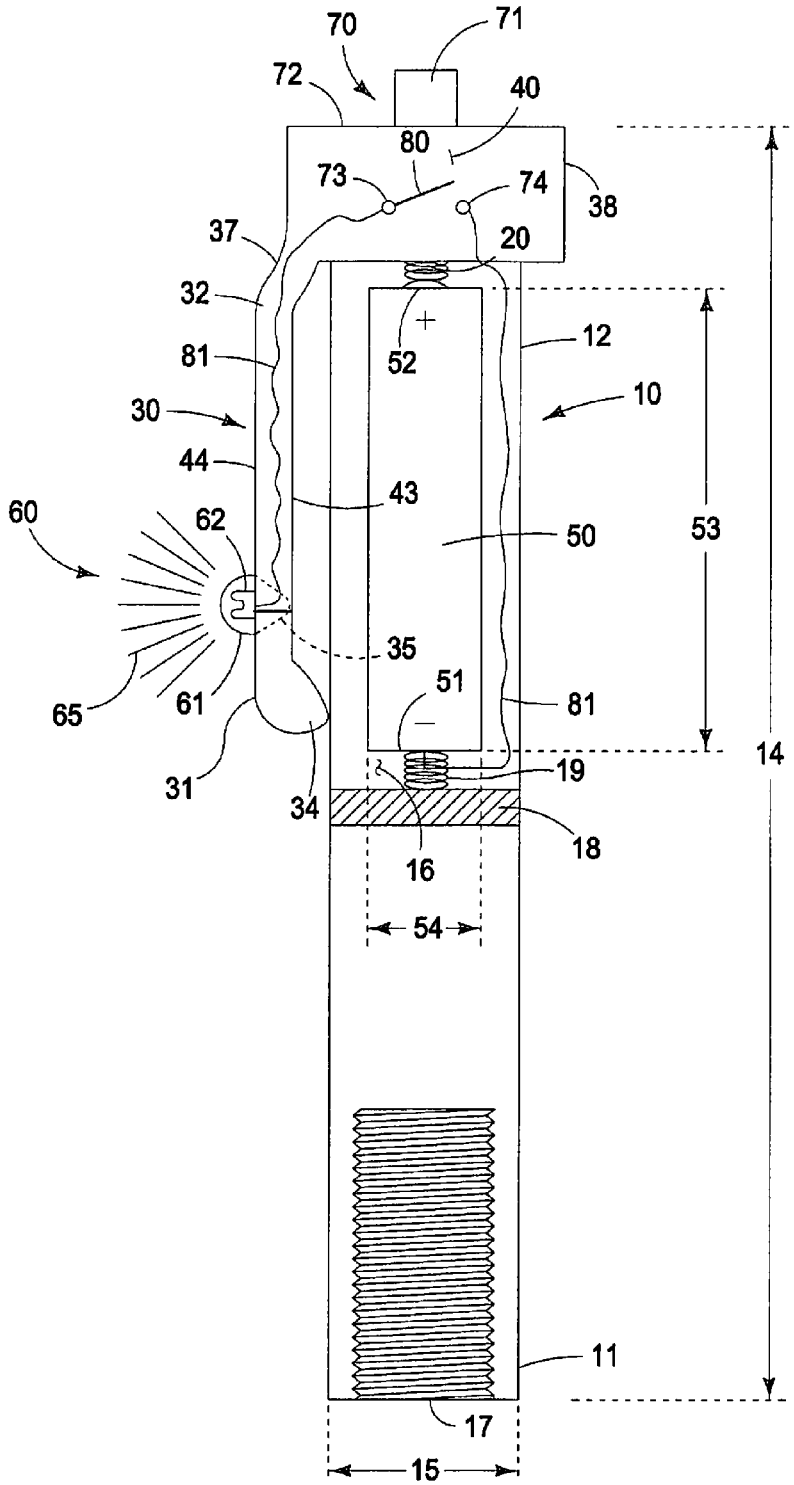
FIG. 6 is an orthographic cross section of the instant invention, showing the power supply, the circuitry and a threaded orifice defined in the bottom of the body for carrying a tool.

A socket 35 is defined in the second surface 44 of the clip 30 proximate to the first end portion 31. The socket 35 defines a generally concave depression (not shown) in which is carried the LED 60. The LED 60, as shown in FIG. 6, has a bulb 61 and an internal element 62 which emits electromagnetic radiation in the form of visible light when supplied with an electric current. The LED 60 is of known construction and therefore a detailed description thereof is unnecessary herein. An electrical trace 81 communicates between the LED 60 and the first electrical contact 73 of the switch 70 (FIG. 6).

As further shown in FIG. 6, the LED 60 is carried within the socket 35 defined in the clip 30. The configuration of the socket 35 and the configuration of the bulb 61 cause electromagnetic radiation generated by the energized element 62 to be emitted in a direction 65 generally radially outward from the bulb and opposite the second surface 44 of the clip 30 and the body 10. The concave depression (not shown) may function as a type of lens directing the emitted electromagnet radiation outwardly therefrom.

Figure 5:
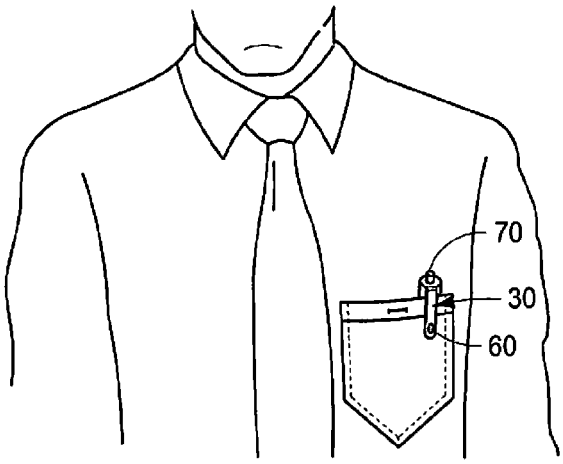
FIG. 5 is an environmental view of the instant invention being carried in a user's shirt pocket with the LED positioned vertically below the user's eye level.

A diametrically enlarged mass 34 is carried at the first end portion 31 of the clip 30. In the preferred embodiment, an edge portion of the diametrically enlarged mass 34 proximate the outer circumferential surface 13 of the body 10 is in very close proximity to the outer circumferential surface 13. The diametrically enlarged mass 34 is used to provide friction with a user's shirt pocket (FIG. 5) to positionally secure the instant invention in a user's pocket by squeezing the fabric of the pocket between the diametrically enlarged mass 34 and the outer circumferential surface 13 of the body 10.

As shown in FIG. 1, the clip 30 may have an offset portion 37 which communicates with the second end portion 32 of the clip 30 and also with a cap 38 carried at the second end portion 12 of the body 10. In the embodiment shown in FIG. 1, the switch 70 is integral with the cap 38 which structurally carries the offset bend 37 and the clip 30. In a second embodiment (FIG. 3), the offset bend 37 and the clip 30 are integral with the body 10 rather than the cap 38. The offset bend 37 spaces the second end portion 32 of the clip 30 radially outwardly from the outer circumferential surface 13 of the body 10 providing a gap (not shown) into which a user's clothing, such as, but not limited to a pocket (FIG. 5) may be carried.

The position of the LED 60 proximate to the first end portion 31 of the clip 30 vertically positions the LED 60 below a user's level of eyesight (not shown). The effect of positioning the LED 60 at such a height is to prevent the LED 60 and its emitted electromagnetic radiation 65 from blinding, or otherwise interfering with a user's vision, and in particular night vision. In the preferred embodiment, the LED 60 emits electromagnetic radiation which is in the visible light wave length spectrum. Further, the LED 60 preferably emits between approximately 1 and 5 lumens of light, such that the LED 60 is not high intensity so it does not project a beam to illuminate a specific spot, but rather the LED 60 widely disburses low intensity electromagnetic radiation that enhances night vision by providing low intensity distinction.

An additional benefit of the instant invention, and the positioning of the LED 60 on the clip 30 is that it allows a user to maintain his/her hands free for other necessities, and the low intensity emitted by the LED 60 prevents the LED 60 from becoming a "target" which criminal elements might use to identify and locate a law enforcement officer in the darkness.

Figure 3:
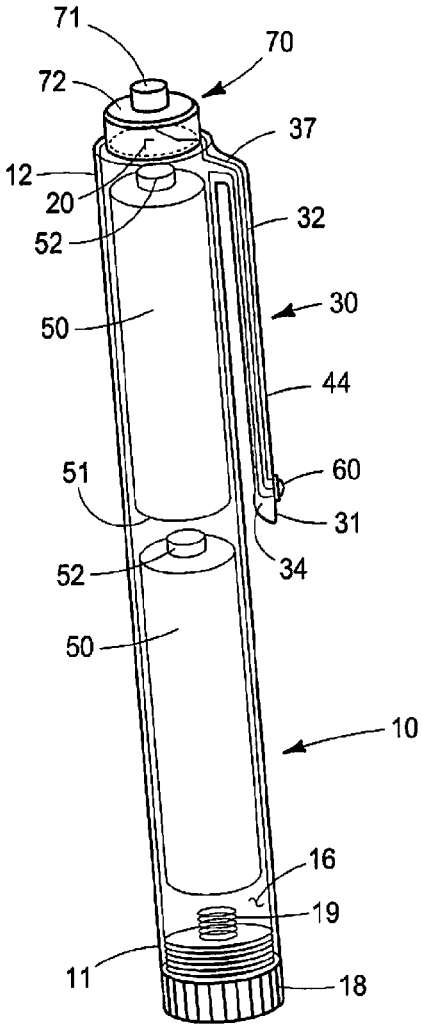
FIG. 3 is an isometric top and side phantom view, similar to that of FIG. 1 showing a double power supply within the medial channel defined by the body.
Figure 4:
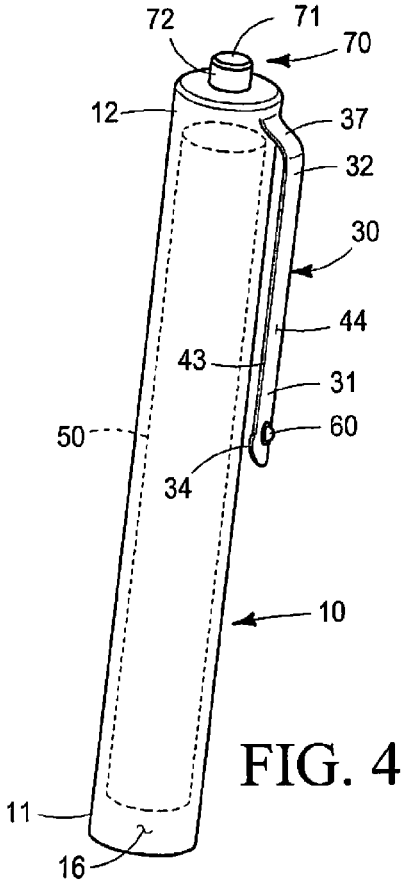
FIG. 4 is an isometric top and side view of the instant invention, showing a second embodiment carrying a single power supply within the medial channel.

As shown in FIG. 3, in one embodiment the base 18 is threadably engaged with the medial channel 16 at the first end portion 11 of the body 10. In another contemplated embodiment, as shown in FIG. 6, the base 18 carried within the medial channel 16 spaced apart from the first end portion 11 of the body 10. In this second possible embodiment, a threaded cavity 17 is defined in the first end portion 11 of the body 10. The threaded cavity 17 is configured to threadably carry a tool (not shown) such as, but not limited to, a handcuff key, a pressure point device, a writing instrument, or other useful device necessary for a user.

Having described the structure of my work light, its operation is hereinafter described.

The body 10 is grasped by a user with his/her hand. The base 18 is unscrewed from the first end portion 11 and a power supply battery 50 is inserted into the medial channel 16. The anodes 51 and the cathodes 52 are aligned for proper operation. Once the power supply battery 50 is inserted into the medial channel 16, the base 18 is threadably replaced to engage with the first end portion 11 of the body 10.

The invention is placed within a user's pocket (FIG. 5) so that the body 10 carrying the power source 50 is within the pocket, and the clip 30 carrying the LED 60 is on the exterior surface of the user's pocket facing forwardly, in the same direction a user would be looking.

In operation, the user would depress the push button 71 switch 70 at the second end portion 12 of the body 10. Depressing the push button 71 completes the electrical circuit 80 (FIG. 2) and allows electrical current to flow through the circuit 80 and pass electrical current to the LED 60, energizing the element 62 and causing emission of electromagnetic radiation 65 from the bulb 61 radially outwardly from the bulb 61 and forwardly from the user's pocket.

In order to deactivate the LED 60, the user would depress the push button switch 71 again which would interrupt the electrical circuit 80 and discontinue the passage of electrical energy to the LED 60.

I claim:

1. A work light comprising:

an elongate body having a first end, a second end, an outer circumferential surface and defining a medial channel extending between the first end and the second end;

a base obstructing the medial channel, the base carrying a first electrode that electrically communicates with an electric circuit;

a cap obstructing the medial channel and spaced apart from the base and carrying a second electrode that communicates with the electric circuit;

a switch communicating with the electric circuit to open the electric circuit and to complete the electric circuit;

a power supply carried within the body medial channel and communicating with both the first electrode and the second electrode;

a clip carried by the body and extending spacedly adjacent and parallel thereto, the clip having a first surface proximate the body and a second surface opposite the body;

a light emitting diode carried on the second surface of the clip and electrically communicating with the circuit and to emit light waves when the electrical circuit is completed by operation of the switch.

2. The work light of claim 1 further comprising:

a threaded orifice defined in the first end of the body to releasably threadably carry a tool.

3. The work light of claim 1 further comprising:

a first electrical trace communicating between the first electrode and a first electrical contact of the switch;

a second electrical trace communicating between the second electrode and the light emitting diode; and a third electrical trace communicating between the light emitting diode and a second electrical contact of the switch.

4. The work light of claim 1 further comprising:

a light emitting diode socket defined in the clip.

5. The work light of claim 1 wherein the body is generally cylindrical and tubular.

6. The work light of claim 1 wherein the power supply is an AAA battery.

7. The work light of claim 1 wherein the power supply is an AA battery.

8. The work light of claim 1 wherein the light emitting diode emits between approximately one lumen of light and five lumens of light.

9. The work light of claim 1 wherein the base is carried at the first end of the body.

10. The work light of claim 1 wherein the switch is a push-button switch.

11. The work light of claim 1 wherein the switch is twist activated.

12. The work light of claim 1 wherein the clip has an end portion opposite the light emitting diode that structurally communicates with the body.

13. The work light of claim 1 wherein the clip has an end portion opposite the light emitting diode that structurally communicates with the cap.

14. A work light comprising:

a generally cylindrical tubular body having a first end, a second end, an outer circumferential surface and defining a medial channel extending between the first end and the second end;

a base carried proximate the first end of the body that obstructs the medial channel, the base carrying a first electrode that electrically communicates with an electric circuit;

a cap carried at the second end of the body and obstructing the medial channel, the cap carrying a second electrode within the medial channel that communicates with the electric circuit and the cap further carrying a switch that communicates with the electric circuit;

a power supply carried within the medial channel and communicating with both the first electrode and the second electrode;

an elongate clip having a first end portion carrying a diametrically enlarged mass, a second end portion communicating with the cap, a first surface spacedly adjacent the outer circumferential surface of the body and a second surface opposite the body, and the elongate clip extends generally parallel to the body from the second end of the body toward the first end of the body;

a light emitting diode carried on the second surface of the clip proximate the first end portion of the clip, the light emitting diode electrically communicating with the circuit and the switch; and the light emitting diode emits electromagnetic waves when the electrical circuit is completed by operation of the switch.

* * * * *